US007377139B1

(12) United States Patent
Yang

(10) Patent No.: US 7,377,139 B1
(45) Date of Patent: May 27, 2008

(54) SPECIFICATION CABINET LOCK

(76) Inventor: Ping-Jan Yang, 18F, No. 71, Sec. 2, Dunhua S. Road, Taipei (TW)

( * ) Notice: Subject to any disclaimer, the term of this patent is extended or adjusted under 35 U.S.C. 154(b) by 0 days.

(21) Appl. No.: 11/592,925

(22) Filed: Nov. 6, 2006

(51) Int. Cl.
*E05B 11/00* (2006.01)

(52) U.S. Cl. ..... 70/78; 70/84; 70/337; 70/345; 70/387; 70/389; 70/429

(58) Field of Classification Search ..... 70/337–343, 70/345–347, 350, 352, 276, DIG. 7, 387, 70/78, DIG. 14, DIG. 63, 389, 429, 430, 70/456 R, 459, 460, 390, 441, 61, 81, 84; 194/253–256, 282–284, 258, 205, 288, 289
See application file for complete search history.

(56) References Cited

U.S. PATENT DOCUMENTS

| | | | | | |
|---|---|---|---|---|---|
| 518,211 | A * | 4/1894 | Johnson | 70/441 |
| 662,322 | A * | 11/1900 | Taber | 346/14 R |
| 1,052,341 | A * | 2/1913 | Holzhauer | 70/389 |
| 2,336,936 | A * | 12/1943 | Johnson | 70/61 |
| 3,882,983 | A * | 5/1975 | Smith et al. | 194/283 |
| 4,114,410 | A * | 9/1978 | Astier | 70/339 |
| 4,918,957 | A * | 4/1990 | Eisermann | 70/276 |
| 5,573,098 | A * | 11/1996 | Widmer | 194/212 |
| 5,937,991 | A * | 8/1999 | Recondo Garayalde | 194/283 |
| 6,529,384 | B1 * | 3/2003 | Haggstrom | 361/759 |
| 7,131,301 | B1 * | 11/2006 | Chang | 70/134 |
| 2006/0070416 | A1 * | 4/2006 | Teratani | 70/389 |

* cited by examiner

*Primary Examiner*—Lloyd A Gall
(74) *Attorney, Agent, or Firm*—Rosenberg, Klein & Lee

(57) ABSTRACT

A cabinet lock includes a lock shell, a lock frame and a restricting device. The lock shell defines a card insertion space, the lock frame includes a slide portion, a hasp portion, an initiative portion and a core, the hasp portion defines a slide groove, the initiative portion is fixed to the hasp portion within the slide groove. The core extends into the main shell to contact with the hasp portion. A block and a protruding portion are defined where the lock block moves away from the stop portion by an external force displacing the extruding portion. Thus, the key can be removed from the core when the card is inserted, and the block locks the card and does not permit removal of the card. The card can be removed when the key is inserted into the core which avoids the loss of the card and the key together.

9 Claims, 4 Drawing Sheets

SPECIFICATION CABINET LOCK

BACKGROUND OF THE INVENTION

1. Field of the Invention

The present invention relates to a structure of a cabinet lock, and more especially to a structure having two locks and being opened by both cards and keys.

2. Description of the Prior Art

At present, locks are used widely by the people and have many types, some locks such as key locks, cabinet locks and number locks which are opened by keys, some locks such as card locks which are opened by insertion of cards.

For cabinet locks, which can be used in some special locations, for instance, natatorium, gymnasium, and so on, users can put goods into a cabinet with the cabinet being locked by a key to avoid losing objects put into the cabinet. However, keys of the cabinets can be inserted and withdrawn freely, which leads to the loss of keys, or, the keys of these cabinet locks may be removed and discarded accidently or through the action of hostile third party. In this way, the original function of the cabinet locks is lost and owners of the cabinets have to have the keys made again or have the cabinets changed. Thus it is very important to prevent the keys from being removed freely when the cabinets are not in use in order to avoid the loss of keys or discarding of the keys.

Thus the inventors of the present invention have the invention concept which obviates the disadvantages of prior lock systems and provides an improvement over existing cabinet lock systems.

SUMMARY OF THE INVENTION

An object of the present invention is to provide a cabinet lock having two locks which are opened with a card and a key. When the card is not in use, the key is placed within the core and cannot be removed, which avoids the loss of the key or the key being discarded spitefully by somebody else. When the card is in use, the key may be removed however the card cannot be removed. To remove the card, it is necessary to insert the key into the core, which avoids the situation where both the key and the card are lost. Thereby, by controlling the card, it may be avoided that not only a key of a cabinet is lost but also keys of an arrangement of cabinet locks may be discarded spitefully by somebody else, which lead to the original function of the cabinet locks being lost.

To achieve the above-mentioned object, a cabinet lock in accordance with the present invention is disclosed. The cabinet lock includes a lock shell defining a card inserted space, a lock frame includes a slide portion, a hasp portion, an initiative portion and a core. The slide portion and the hasp portion are set movably inside the main shell, an end of the slide portion defines a stop portion, and the hasp portion defines a slide groove. The initiative portion passes through the slide portion and is set in the slide groove. An end of the core extends into the main shell to contact with the hasp portion and another end of the core extends out of the lock shell. A restricting device includes a lock block and an elastic module, the lock block is pivoted in the main shell. A block and a protruding portion extend from an end of the lock block and are near to each other. The protruding portion is longer than the block and the block is close to the slide portion, and part of the lock block is located in the stop portion to lock the slide portion. The lock block is displaced from the stop portion by an outside force displacing the extruding portion. Two ends of the elastic module support another end of the protruding portion and an inside wall of the back board of the lock shell respectively which then provides the lock block with the function of elastic replacement.

Benefit of the present invention is that when the card is not in use, the key cannot be taken away because that the key is placed within the core and the lock block locks the slide portion, which result in that the hasp portion and the core being unable to rotate, so key loss is avoided or the key being discarded by somebody else. When the card inserted space is inserted with a card, the protruding portion moves by outside force, at the same time, the block moves towards the card, so the lock block can be displaced from the stop portion, which allows the slide portion to move, thus, the block can buckle with the card, which fixes the card and the key can be taken out of the core.

To further understand features and technical contents of the present invention please refer to the following detailed description and drawings related the present invention. But the drawings are only used to be references and explanations, not be limits to the present invention.

DETAILED DESCRIPTION OF THE INVENTION

Figure 1:
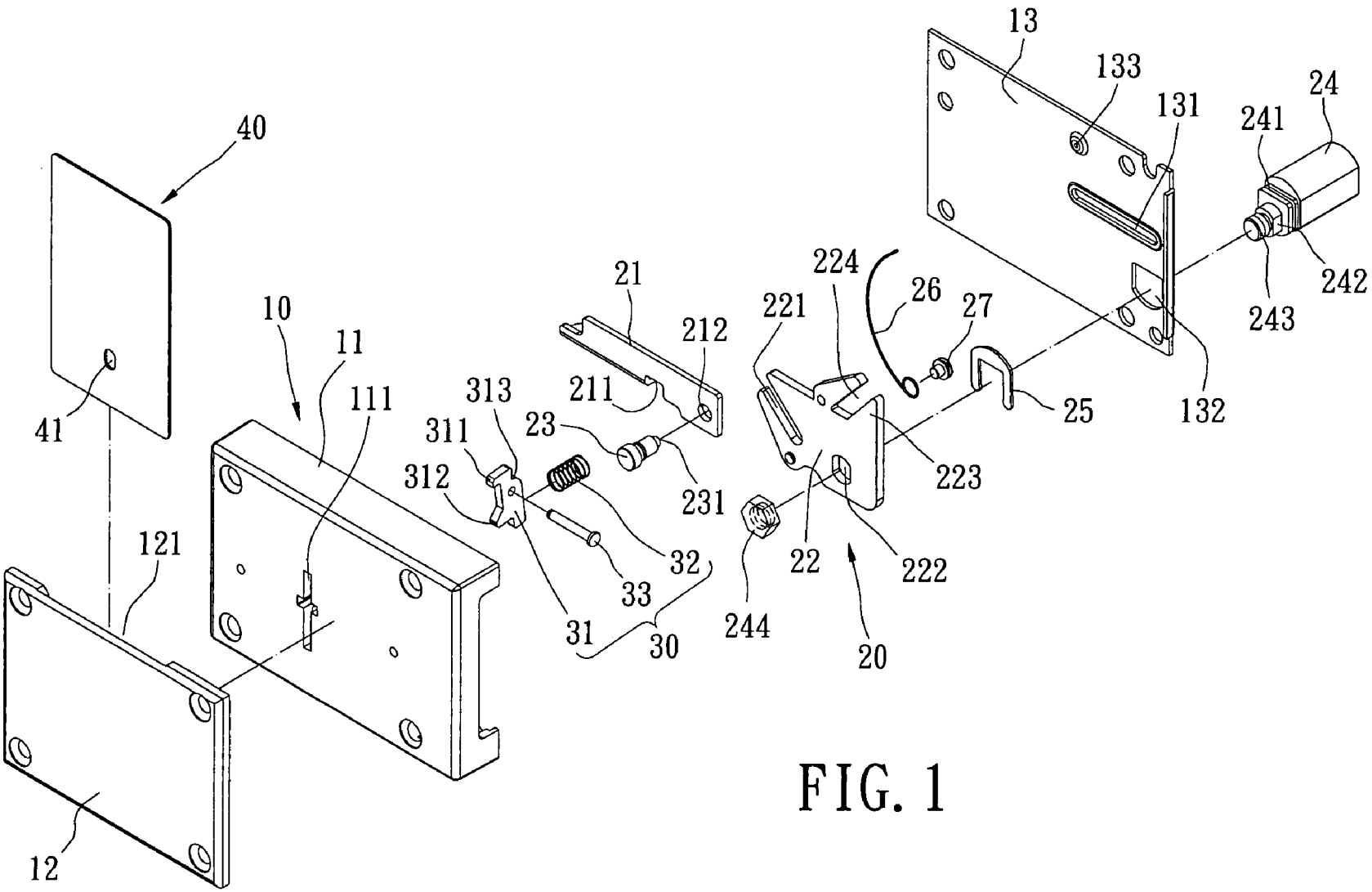
FIG. 1 is an exploded isometric view of the present invention.
Figure 2:
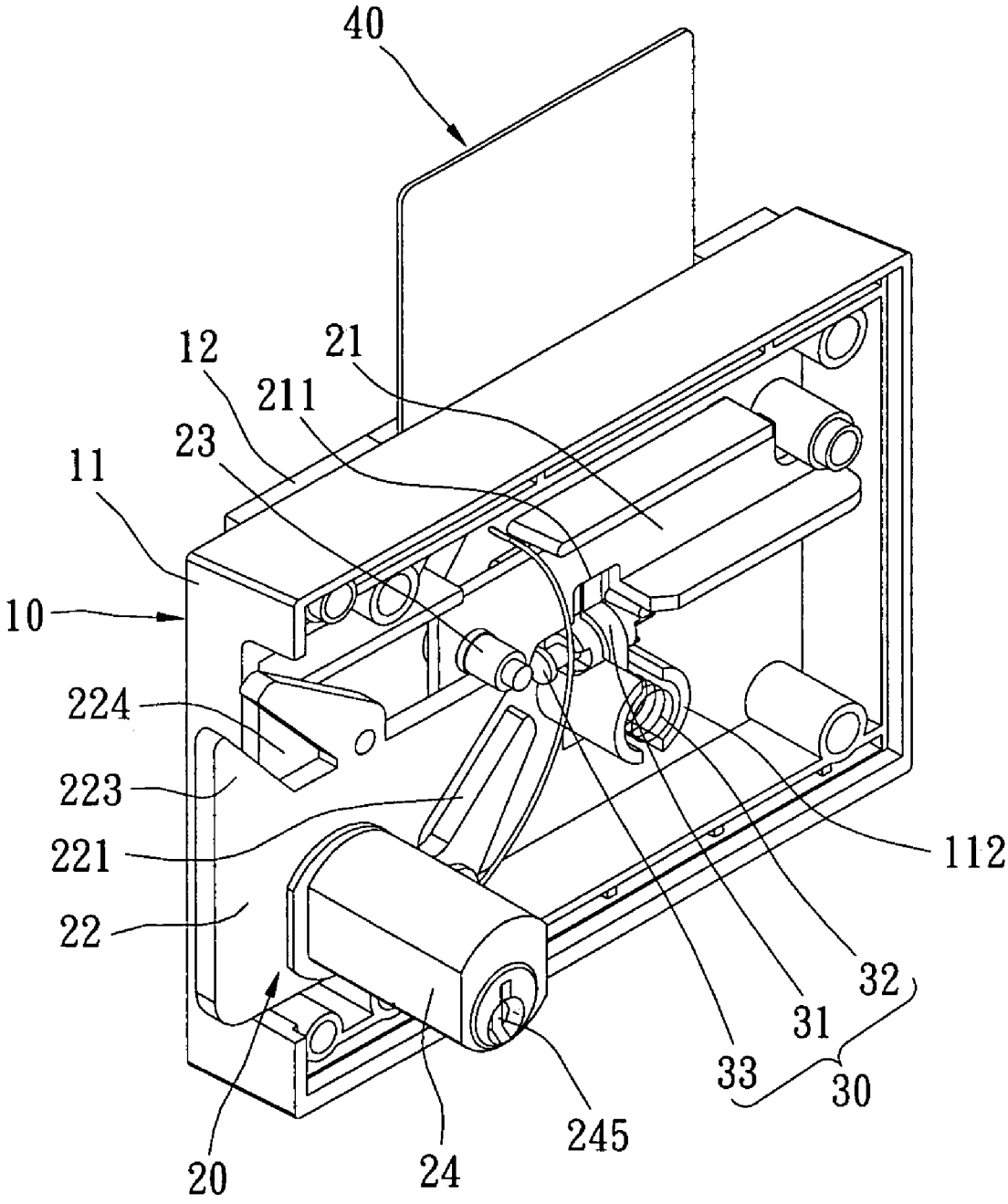
FIG. 2 is an assembled isometric view of the present invention.
Figure 3:
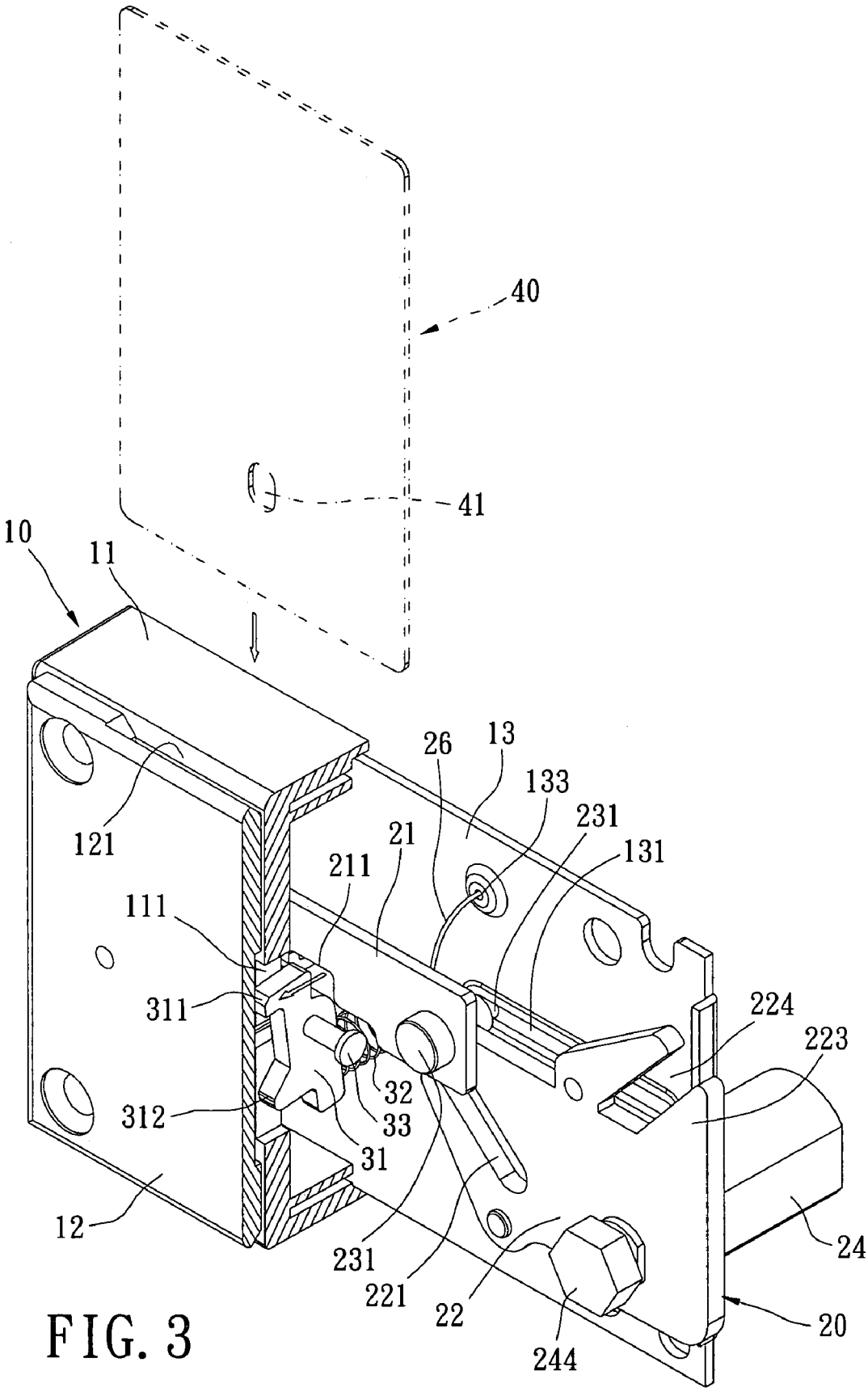
FIG. 3 is an isometric partial cross-section reference drawing of operation of the present invention.

Referring to FIG. 1 to FIG. 3, a cabinet lock set in a door plank of the present invention is provided. The cabinet lock is unlocked by both a card and a key. The cabinet has a lock shell 10, a lock frame 20 and a restricting device 30.

The lock shell 10 defines a main shell 11, a cover 12 and a back board 13. A surface of the main shell 11 defines a notch 111 there on, and an extending portion 112 is extended outwards from the inside of the notch 111. The cover 12 can be locked onto an end of the main shell 11 as corkscrew, and defines a card inserted space 121 with the main shell 11, the notch 111 and the extending portion 112 are corresponding to the card inserted space 121. The back board 13 can be locked onto another end the main shell 11 as corkscrew, a surface of the back board 13 defines a slide notch 131, an opening 132 and a fastening hole 133 thereon.

The lock frame 20 has a slide portion 21, a hasp portion 22, an initiative portion 23, a core 24, a buckle piece 25 and an elastic thread 26 which can generate a twisting force. The slide portion 21 and the hasp portion 22 are displaceably mounted inside the main shell 11. The back board 13, defines a stop portion 211 which is grooved at the bottom of the slide portion, and includes a through hole 212 passing through the slide portion 21. The hasp portion 22 defines an inclined a slide groove 221, an integrating hole 222, an extruding portion 223 and an inclined hasp groove 224, the hasp groove 224 is adjacent the slide groove 221. The initiative portion 23 is fixed through the through hole 212 of the slide portion 21, and passes through the through hole 212 and then is positioned to locate in the slide groove 221 of the hasp portion 22. A protruding portion 231 extends towards the back board 13 and is positioned in the slide notch 131.

The core 24 is a standard lock case. An end of the core 24 defines a buckle portion 241 having a slot encircled therein. An integrating portion 242 extends from the buckle portion 241, and a corkscrew lock portion 243 extends from the integrating portion 242 and is secured to the screw cap 244. The buckle portion 241 of the core 24 passes through the opening 132 of the back board 13, and then the integrating portion 242 and the corkscrew lock portion 243 extend into the main shell 11. The buckle piece 25 is U shape, and is buckled to the buckle portion 241 to clip and stabilize the core 24 in the lock shell 10. The integrating portion 242 is integrated with the integrating hole 222 of the hasp portion 22 to allow the hasp portion 22 to be in cooperation with the core 24, and to stabilize the hasp portion 22 by the corkscrew locking with a screw cap 244 of the corkscrew lock portion 243. The other end of the core 24 extends external to the back board 13, and a lock hole 245 formed therein to provide a hole for a key (not be shown) to be inserted.

The elastic thread 26 is made of an elastic material and has an appropriate elasticity. One end of the elastic thread 26 is inserted into the fastening hole 133 of the back board 13, and the other end contacts the hasp portion 22. The elastic thread 26 enlaces a connector 27 and the connector 27 is fixed in the hasp portion 22 to provide the hasp portion 22 with a biasing force.

The restricting device 30 has a lock block 31, an elastic module or spring 32 and a pivot pin 33. A block 311 and a protruding portion 312 are defined on an end of the lock block 31 and are close to each other. The protruding portion 312 is longer than the block 311. A concave 313 which is formed in the other end of the lock block 31 is on the same side as the block 311, with one side of the protruding portion 312 being downwardly declined. The lock block 31 is set in the notch 111 and the extending portion 112 of the main shell 11. The pivot 33 passes through the extending portion 112 and the lock block 31 synchronously to allow the lock block 31 to be pivoted in the main shell 11. The block 311 and the protruding portion 312 extends into the card insertion space 121 passing through the notch 111.

The block 311 is adjacent to the slide portion 21, and part of the lock block 31 is positioned in the stop portion 211 of the slide portion 21. The elastic module 32 is a spring and may be set in the extending portion 112. An end of the elastic module 32 supports another end of the protruding portion 312, and another end supports the inside wall of the back board 13 of the lock shell 10, which provides the lock block 31 to be elastically displaced.

Figure 4:
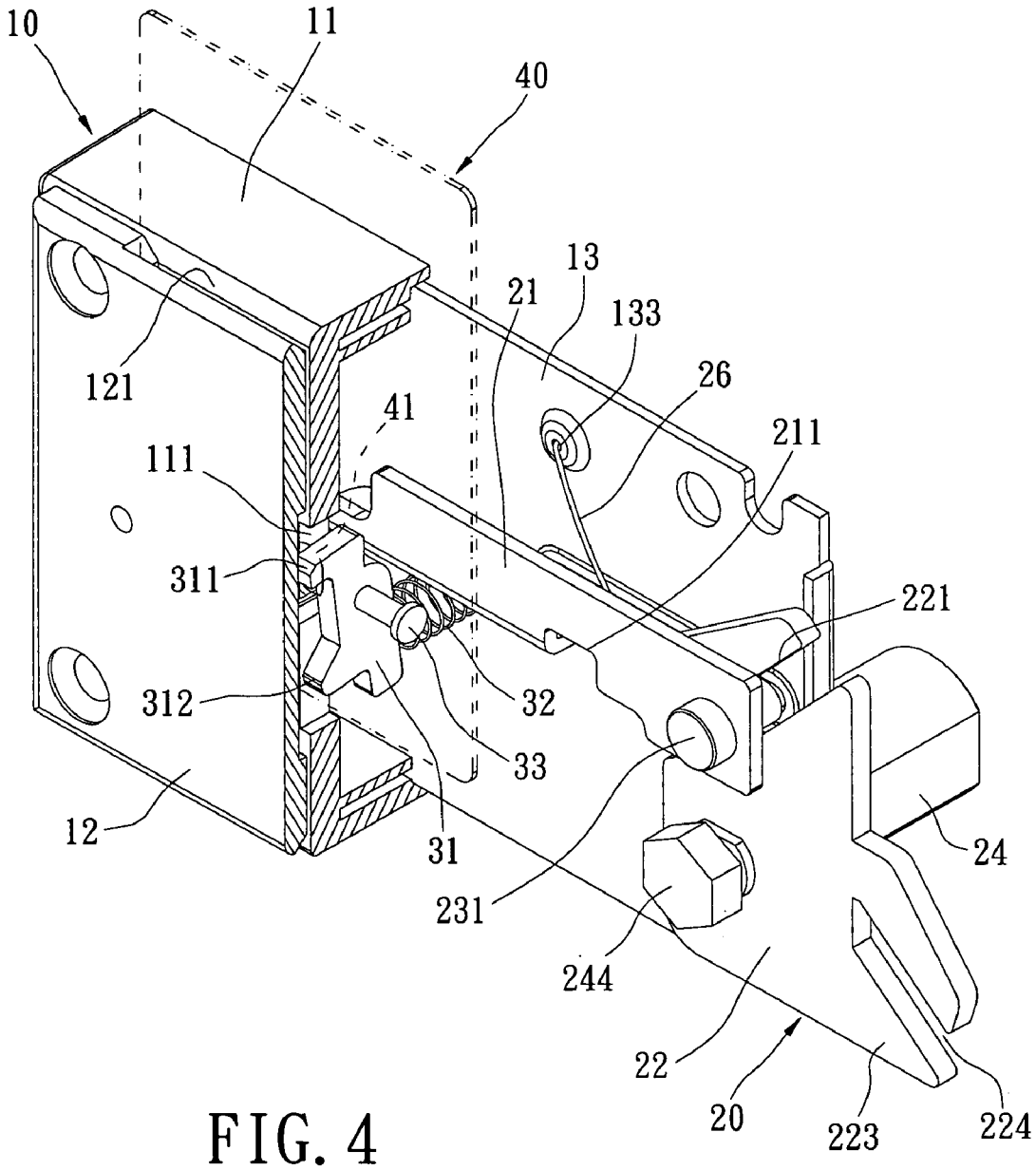
FIG. 4 is another isometric partial cross-section reference drawing of operation of the present invention.

Referring to FIGS. 1, 3 and 4, the actions of the present invention are shown during operation. A key is inserted into the keyhole 245 of the core 24 in advance and cannot be removed. A card 40 may be inserted into the card insertion space 121 of the lock shell 10. A hole 41 is defined on the card 40, when inserted into the card insertion space 121, the card 40 touches the incline of the protruding portion 312. The protruding portion 312 moves towards the slide portion 21 and displaces the block 311 towards the card 40 synchronously by the force on the card 40. When the card 40 is displaced to a predetermined position, the lock block 31 will exit the stop portion 211 to allow the slide portion 21 to move, and the block 311 is buttoned into the hole 41 of the card 40. Thus the card 40 cannot be removed. The function of the concave 313 is to shorten the distance between the lock block 31 and the stop portion 211.

When a user rotates the core 24 by a key to make the hasp portion 22 rotate, the movement of the slide groove 221 makes the initiative portion 23 drive the slide of the slide portion 21 towards the hasp portion 22, and also makes the protruding portion 231 slide in the slide notch 131. The extruding portion 223 extends out of the lock shell 10 when the core 24 is rotated to a final position which makes the hasp groove 224 button onto an object (not shown), and then the system is locked. Thereby, the user can take out the key.

When the user put the key into the core 24 again and rotates the core 24 to the original position, the hasp portion 22 and the slide portion 21 are displaced to the original position. The lock block 31 is displaced back into the stop portion 211 due to the elasticity of the elastic module 32 and at the same time, the block 311 is moved external the hole 41 of the card 40, and then, the card 40 may be taken out of the lock shell 10.

In summary, when the card 40 is not in use, the key is placed within the core 24, the lock block 31 locks the slide portion 21, which results in that the hasp portion 22 and the core 24 unable to rotate. Thus in this case the key cannot be taken away and avoids loss or being discarded by somebody else. When the card 40 is in use, the key may be taken away by the said action, but the card 40 cannot be taken away. To avoid the key and the card 40 being lost together, it is necessary to insert the key into the core 24 and then to remove the card 40. Thereby, by controlling on the card 40, the user of the cabinet can avoid not only key loss but also spiteful discarding of a key by somebody else.

What is disclosed above only is a preferred embodiment of the present invention, and therefore it is intended that the present invention not be limited to the particular embodiment disclosed. It will be understood by those skilled in the art that various equivalent changes may be made depending on the specification and the drawings of present invention without departing from the scope of the present invention.

What is claimed is:

1. A cabinet lock, comprising:

a lock shell defining a card inserted space;

a lock frame comprising a slide portion, a hasp portion, an initiative portion and a core, the slide portion and the hasp portion are set movably inside a main shell, the slide portion includes a stop portion formed therein, and the hasp portion defines a slide groove, the initiative portion is fixed to the hasp portion within the slide groove, an end of the core extends into the main shell to contact with the hasp portion, another end of the core extends outwards of the lock shell; and a restricting device comprising a lock block and an elastic module, the lock block is pivoted in the main shell, a block and a protruding portion are defined on an end of the lock block extendedly and are close to each other, and the protruding portion is longer than the block somewhat, the block is near to the slide portion, and part of the lock block locates in the stop portion to lock the slide portion, and the lock block moves away from the stop portion by an external force to allow displacing an extruding portion, two ends of the elastic module support another end of the protruding portion and an inside wall of a back board of the lock shell respectively, which provides the lock block with a function of elastic replacement.

2. The cabinet lock as claimed in claim 1, wherein the lock shell includes, a cover combined with an end of the main shell, and the back board is combined with the other end of the main shell, said card inserted space being defined between the cover and the main shell.

3. The cabinet lock as claimed in claim 2, wherein the main shell defines a notch thereon, and an extending portion is extended outwardly from the inside of the notch, the lock block is pivoted in the extending portion and the notch to make the block extend into the card inserted space.

4. The cabinet lock as claimed in claim 2, wherein the back board defines a slide notch, a protruding portion is protruded towards the back board thereof to be located in the slide notch.

5. The cabinet lock as claimed in claim 1, wherein the lock frame has a buckle piece, the buckle piece is buckled to the core to clip and stabilize the core in the lock shell, and an elastic thread, two ends of the elastic thread are combined with the lock shell and the hasp portion respectively to make the hasp portion have a function of elastic replacement.

6. The cabinet lock as claimed in claim 5, wherein the core has a buckle portion where an integrating portion extends from the buckle portion, and a corkscrew lock portion is extended from the integrating portion, the buckle piece is buckled to the buckle portion, the hasp portion is integrated with the integrating portion, the corkscrew lock portion has a screw cap to stabilize the hasp portion.

7. The cabinet lock as claimed in claim 5, wherein the elastic thread enlaces a connector, the connector is set in the hasp portion.

8. The cabinet lock as claimed in claim 1, wherein the extruding portion extrudes from the hasp portion thereof, the extruding portion defines a hasp groove thereon, the hasp groove is near to the slide groove.

9. The cabinet lock as claimed in claim 1, wherein a concave is defined on the other end of the lock block, the concave is corresponding to the stop portion.

* * * * *